US007908986B2

(12) United States Patent
Ji

(10) Patent No.: US 7,908,986 B2
(45) Date of Patent: Mar. 22, 2011

(54) METHOD OF SEWING A TRADEMARK OF CLOTHES FOR BEING HIDDEN INTO A POCKET

(76) Inventor: Weilin Ji, Shanghai (CN)

( * ) Notice: Subject to any disclaimer, the term of this patent is extended or adjusted under 35 U.S.C. 154(b) by 434 days.

(21) Appl. No.: 12/092,468

(22) PCT Filed: Oct. 19, 2006

(86) PCT No.: PCT/CN2006/002764

§ 371 (c)(1),
(2), (4) Date: May 22, 2008

(87) PCT Pub. No.: WO2007/054008

PCT Pub. Date: May 18, 2007

(65) Prior Publication Data

US 2008/0250996 A1 Oct. 16, 2008

(30) Foreign Application Priority Data

Nov. 8, 2005 (CN) ..... 2005 1 0110128

(51) Int. Cl.
*D05B 13/00* (2006.01)
*D05B 35/06* (2006.01)
*A41D 27/20* (2006.01)

(52) U.S. Cl. ..... 112/475.09; 2/249

(58) Field of Classification Search ..... 112/99, 112/104, 147, 152, 470.33, 475.08, 475.09; 2/247–252

See application file for complete search history.

(56) References Cited

U.S. PATENT DOCUMENTS

| | | | | |
|---|---|---|---|---|
| 922,608 | A * | 5/1909 | Mayer | 2/247 |
| 3,193,842 | A * | 7/1965 | Bell | 2/94 |
| 4,650,219 | A * | 3/1987 | Sigman | 283/70 |
| 5,624,514 | A * | 4/1997 | Frowein | 156/148 |
| 5,628,065 | A * | 5/1997 | Austin | 2/81 |
| 6,175,966 | B1 | 1/2001 | Wiesenthal | |
| 2004/0035526 | A1 * | 2/2004 | Chamandy et al. | 156/293 |
| 2004/0261159 | A1 * | 12/2004 | Reilly et al. | 2/422 |

FOREIGN PATENT DOCUMENTS

| | | | |
|---|---|---|---|
| CN | 2259772 | Y | 8/1997 |
| CN | 1504130 | A | 6/2004 |
| CN | 1692850 | A | 11/2005 |

OTHER PUBLICATIONS

International Search Report with English Translation from PCT/CN2006/002764 mailed Feb. 1, 2007 (4 pages).

International Preliminary Report on Patentability (Chapter I) issued May 22, 2008, from the International Bureau in related International Application No. PCT/CN2006/002764 (6 pages).

* cited by examiner

*Primary Examiner* — Ismael Izaguirre
(74) *Attorney, Agent, or Firm* — Osha • Liang LLP

(57) ABSTRACT

A method of sewing a trademark of clothes for being hidden into a pocket, in which a trademark pocket is provided at a trademark position correspondingly for hiding the trademark. The trademark pocket is an outside or inside trademark pocket, or a flat trademark hanging bag. When the clothes is worn in a way of touching the body shin, the trademark will not rub the body skin uncomfortably.

12 Claims, 1 Drawing Sheet

METHOD OF SEWING A TRADEMARK OF CLOTHES FOR BEING HIDDEN INTO A POCKET

FIELD OF THE INVENTION

The present invention relates to a method of sewing a trademark of clothes, particularly to a method of sewing a trademark of clothes for being hidden into a pocket.

BACKGROUND OF THE INVENTION

In currently known methods of sewing clothes trademark, a trademark of clothes is sewn directly and fixedly onto the position of the clothes for trademarks, wherein the trademarks in underwear, such as shirts and T-shirts, are sewn at the portion of collar band, the trademarks in the skirts and pants are sewn in the waist portion. The trademark cannot be hidden in a pocket. The trademarks are woven from chemical fiber, which is relatively more rough and harder than the face fabric of the clothes, which is generally soft and smooth. The trademark will undesirably rub the skin when one wears the clothes in a way that the clothes touch the skin, so that the one wearing the clothes will feel uncomfortable. It is usual that when one buys underwear, such as shirts and T-shirts, he or she will remove the trademark because of the uncomfortable feeling. On the contrary, the manufacturers hope that the trademark can remain on the clothes permanently, so that the brand will be remembered forever. Thus, a situation of dilemma occurs.

The present application is identical to Chinese Patent Application No. 200510026090.2, entitled "A Sewing Method of a Trademark Being Turnable to Be Hidden" in technical field, technical background, and technical effects, while totally different from it in the technical solution and embodiments.

SUMMARY OF THE INVENTION

In order to overcome the drawbacks of clothes manufactured by the prior art sewing method, which drawback is that the trademark rub the skin undesirably when one wears the clothes in a way that the clothes touch the skin, the present invention provides a method of sewing a trademark of clothes for being hidden into a pocket. The sewing method remains the position of the trademark in the clothes and the process of manufacturing the trademark unchanged. The method facilitates in hiding the trademark into a pocket, so as to avoid the trademark from undesirably rubbing the body skin when the clothes is worn in a way that the clothes touch the body skin. Thus, one wearing the clothes will feel comfortable, so as to avoid the wearer to remove the trademark because of the uncomfortable feeling.

The technical solution to solve the technical problem of the present application is as follows: according to the specific positions of the trademark of clothes and the specific shapes and sizes of the trademark of clothes, a trademark pocket for receiving and hiding the trademark of clothes is provided at a position corresponding to the trademark. The trademark pocket can be outside or inside pocket fixedly sewn, or can be a flat hanging pocket sewn in a form of being hung.

In the case that the trademark pocket is an outside or an inside trademark pocket sewn vertically, a length of trademark hanging band is cut first, and an upper edge of the trademark is sewn to a lower edge of the trademark hanging band; or, an upper edge fixing portion of the trademark hanging band is maintained not being covered by the trademark in advance, then the trademark is attached to the trademark hanging band; an upper edge of the trademark hanging band is fixedly sewn over a pocket mouth of the outside or inside trademark pocket, so that the trademark hanging band sewn with the trademark is in a form of being hung, thus the trademark can be easily put into the outside or inside pocket when needed to be hidden. Or, the upper edge of the trademark can be directly fixedly sewn over the pocket mouth of the trademark pocket, so that the trademark is in a form of being hung, thus the trademark can be easily put into the outside or inside pocket when it is desired to be hidden. Further, a yoke is sewn in parallel over the pocket mouth, i.e., along the fixed sewing line of the upper edge of the trademark. If the yoke extends beyond the pocket mouth a greater length, then it is called a yoke, and if the yoke extends beyond the pocket mouth a less length, then it is called a flap. When the trademark is hidden into the pocket, the yoke or the flap can effectively cover the upper edge of the trademark, which exposes over the pocket mouth of the outside or inside trademark pocket.

When it is desired to represent the trademark to seethe contents thereof, it is sufficient to take the trademark or the trademark hanging band out of the outside or inside pocket.

In the case that the trademark pocket is a flat hanging pocket sewn in a form of being hung, the length and the width of the hanging pocket will greater than or equal to those of the trademark. The two faces fabric of the pocket shall be in a form that the upper edge of one face fabric is slightly higher than that of the other face fabric. The higher upper edge of the face fabrics is an upper fix portion of the trademark hanging pocket, which pocket is sewn at the trademark position of clothes, so that the trademark hanging pocket is in a form of being hung. The trademark hanging pocket can be sewn positively, in which case the pocket mouth faces outside, or the trademark hanging pocket can be sewn oppositely, in which case the pocket mouth faces inside. The trademark shall be fixed in advance to the face of the pocket that faces outside no matter whether the pocket is sewn positively or oppositely. In alternative, the trademark can take the place of the face of the trademark hanging pocket that faces outside, in which case a left end and a right end of the trademark is sewn on the left end and the right end of the trademark hanging pocket respectively, so as to form a trademark hanging pocket with the bottom thereof is not sewn and opened. When it is desired to hide the trademark, the trademark hanging pocket shall only be turned over from the bottom. With the pocket mouth, which originally faces outside, is turned inside, or the pocket mouth, which is originally inside, is turned outside, the face sewn with the trademark is turned into the pocket.

When it is desired to represent the trademark to observe the contents of the same, it is sufficient to turn over the trademark hanging pocket again to the original form.

When the trademark pocket is an outside or inside trademark pocket fixedly sewn horizontally, the corresponding trademark, trademark hanging band and yoke are sewn horizontally accordingly.

The outside or inside trademark pocket can be a patch pocket, an open pocket, a set-in pocket, a sandwich pocket, a seam pocket, or other type of outside or inside pocket.

The shape of the outside or inside trademark pocket and the trademark hanging pocket can be circular, semi-circular, square, rectangular, or any other shape. The bottom of the pocket can be sewn to close, or can be un-sewn to open.

The face fabric of the outside or inside trademark pocket and the trademark hanging pocket, the trademark hanging band, and the yoke can be the same as that of the clothes. Or, for the sake of comfort and color coordinating, they can use face fabric of other materials and colors.

When the trademark hanging band and the trademark hanging pocket is made to be larger than the trademark, a mark label, including graphic symbols for use of the clothes, is together with the trademark onto the trademark hanging band and the trademark hanging pocket.

The advantageous effects of the present invention is that the present position of the trademark on clothes and the present manufacturing process of the trademark is maintained unchanged, while the trademark can be hidden easily into a pocket, so as to avoid undesired rub to the body skin when the clothes is worn in a way of touching the skin, thus to make it comfortable to wear. Further, it can also avoid the customers from removing the trademark due to the uncomfortable feeling. The cost is substantially reduced since the manufacturing process is relatively simple and relatively less material is used.

BRIEF DESCRIPTION OF THE DRAWINGS

The present invention will be further described in the followings with reference to the drawings, in which.

In the figurers, 1—outside or inside trademark pocket, 2—pocket mouth, 3—trademark, 4—trademark hanging band, 5—yoke, 6—trademark hanging pocket.

DETAILED DESCRIPTION OF THE INVENTION

Figure 1:
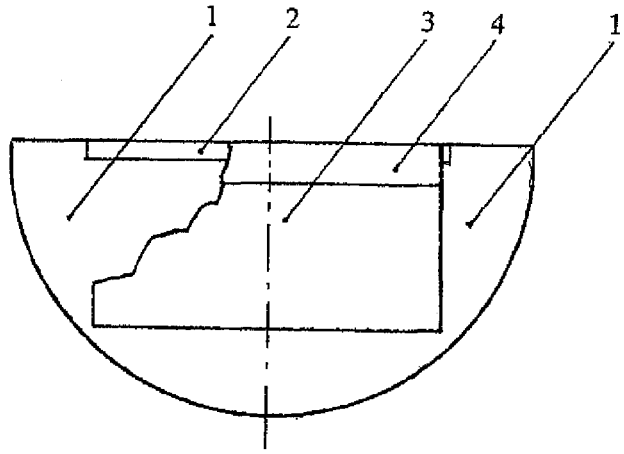
FIG. 1 is a sectional diagrammatic view of a first embodiment according to the present invention.

In the first embodiment shown in FIG. 1, a semi-circular shaped outside trademark pocket 1 is sewn at a trademark position of clothes. A pocket mouth 2 retracts downwardly. An upper edge of a trademark hanging band 4 sewn with a trademark 3 is fixedly sewn over the pocket mouth 2 so as to be in a form of being hung. Thus, when it is desired, the trademark can be inserted easily into the outside trademark pocket 1 to be hidden.

Figure 2:
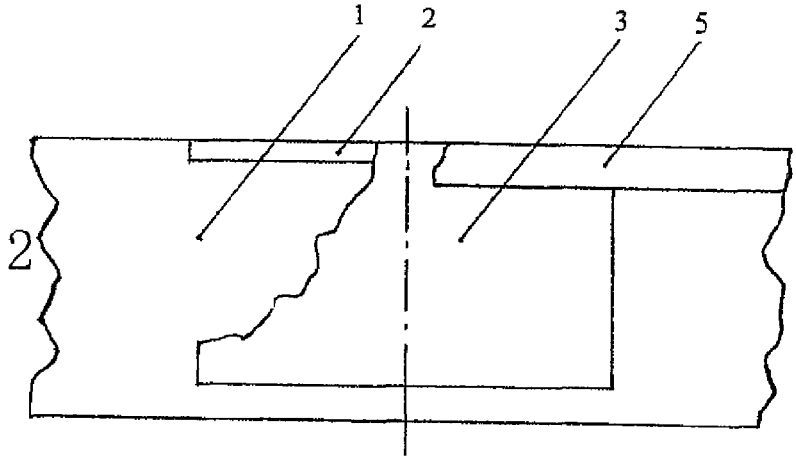
FIG. 2 is a sectional diagrammatic view of a second embodiment according to the present invention.

In the second embodiment shown in FIG. 2, an inside trademark pocket 1 is made by sewing two layer of face fabric at left and right sides thereof and leaving a pocket mouth 2 therebetween. An upper edge of a trademark 3 is fixedly sewn over the pocket mouth 2, so that the trademark is in a form of being hung. Thus, when it is desired, the trademark can be inserted easily into the inside trademark pocket 1 to be hidden. Further, a yoke 5 is manufactured in parallel over the pocket mouth 2, i.e. along the fixed sewing line of the upper edge of the trademark 3. If the yoke 5 extends beyond the pocket mouth 2 a greater length, then it is called a yoke 5, and if the yoke 5 extends beyond the pocket mouth 2 a less length, then it is called a flap. When the trademark 3 is hidden into the pocket, the yoke 5 can function as a flap to efficiently cover the upper edge of the trademark 3 which exposes over the pocket mouth of the inside trademark pocket.

Figure 3:
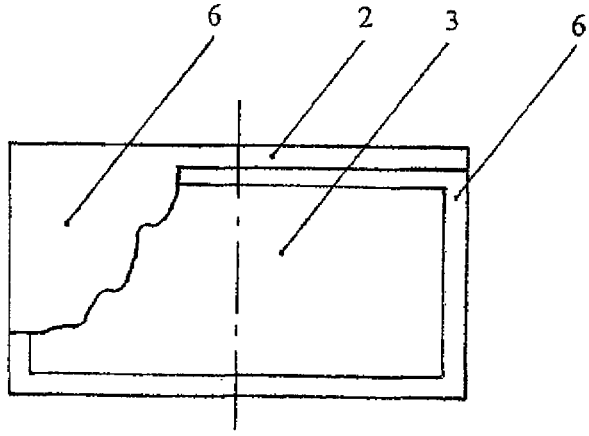
FIG. 3 is a sectional diagrammatic view of a third embodiment according to the present invention.

In the third embodiment shown in FIG. 3, a flat trademark hanging pocket 6 is sewn, such that an upper edge of one face fabric of the pocket is a slightly higher than that of the other face fabric. The upper edge of the face fabric that is slightly higher is the upper edge of the trademark hanging pocket, which is positively sewn at a trademark position of clothes, so as to be in a form of being hung and the pocket mouth 2 faces outside. The trademark 3 is fixedly sewn in advance at the face of the pocket hanging pocket 6 that faces outside. When the trademark 3 is to be hidden into the pocket, the trademark hanging pocket is turned over from the bottom. As the pocket mouth 2, which originally faces outside, being turned inside, the face, to which the trademark 3 attaches, is turned into the pocket.

I claim:

1. A method of fixing a trademark on a clothing, comprising:

providing a trademark pocket for receiving and hiding the trademark at a location on the clothing for placing the trademark, wherein the trademark pocket is designed to accommodate the trademark according to a specific shape and size of the trademark; and fixing the trademark at a location proximate an opening of the trademark pocket such that the trademark is capable of being hidden in the trademark pocket or being exposed for display, wherein the trademark pocket is an outside or an inside trademark pocket fixedly sewn on the clothing, or a flat trademark hanging pocket sewn on the clothing in a form of being hung.

2. The method according to claim 1, wherein the trademark pocket is the outside trademark pocket or the inside trademark pocket, wherein the trademark pocket is sewn in a vertical configuration with the opening facing upward, wherein the trademark is sewn via an upper edge thereof to a lower edge of a trademark hanging band, wherein an upper edge of the trademark hanging band is fixedly sewn at the location proximate the opening of the outside or inside trademark pocket so that the trademark hanging band together with the trademark is hung around the opening of the trademark pocket, thereby the trademark can be inserted into the outside or inside trademark pocket when it is desired to be hidden.

3. The method according to claim 2, wherein the upper edge of the trademark hanging band is sewn at the location proximate the opening of the trademark pocket, followed by attaching the trademark to the lower edge of the trademark hanging band.

4. The method according to claim 1, wherein the trademark pocket is the outside trademark pocket or the inside trademark pocket, wherein the trademark pocket is sewn in a vertical configuration with the opening facing upward, wherein an upper edge of the trademark is fixedly sewn at the location proximate the opening of the trademark pocket, so that the trademark is in a form of being hung, thereby the trademark can be inserted into the outside or inside trademark pocket when it is desired to be hidden.

5. The method according to claim 1, wherein the trademark pocket is the flat trademark hanging pocket, wherein the flat trademark hanging pocket comprises two face fabrics arranged in such a form that an upper edge of one face fabric is slightly higher than that of the other face fabric, wherein the higher upper edge of the face fabrics is sewn at the location on the clothing for placing the trademark so that the flat trademark hanging pocket is in the form of being hung, wherein the trademark is fixed to a face of the flat trademark hanging pocket that faces outside, or the trademark forms the face of the flat trademark hanging pocket that faces outside, wherein a left edge and a right edge of the trademark are sewn on a left edge and a right edge of the flat trademark hanging pocket, respectively, so as to form the flat trademark hanging pocket with the bottom thereof not sewn to the clothing, so that the trademark hanging pocket is capable of being flipped inside out to turn the face sewn with the trademark into the flat trademark hanging pocket.

6. The method according to claim 1, wherein the trademark pocket is the outside trademark pocket or the inside trademark pocket fixedly sewn in a horizontal configuration with the opening of the trademark pocket facing sideway, wherein the trademark, is also sewn in a horizontal configuration.

7. The method according to claim 1, wherein the outside or inside trademark pocket is a patch pocket, an open pocket, a set-in pocket, a sandwich pocket, or a seam pocket.

8. The method of sewing according to claim 1, wherein a shape of the outside or inside trademark pocket or the flat trademark hanging pocket is circular, semi-circular, square, or rectangular, and wherein a bottom of the trademark pocket can be sewn shut or un-sewn to remain open.

9. The method according to claim 1, wherein a face fabric of the outside or inside trademark pocket or the flat trademark hanging pocket is made of the same material as that of the clothing.

10. The method according to claim 1, further comprising sewing a mark label, including graphic symbols for use of the clothes, together with the trademark.

11. The method according to claim 2, wherein the trademark is attached to the lower edge of the trademark hanging band, followed by sewing the upper edge of the trademark hanging band at the location proximate the opening of the trademark pocket.

12. The method according to claim 4, further comprising:

sewing a yoke or a flap over the opening of the trademark pocket so that when the trademark is hidden in the trademark pocket, the yoke or the flap can cover the upper edge of the trademark that is exposed over the opening of the trademark pocket.

* * * * *